US007310087B2

(12) United States Patent
Ha

(10) Patent No.: US 7,310,087 B2
(45) Date of Patent: Dec. 18, 2007

(54) METHOD OF CONTROLLING UNIVERSAL REMOTE CONTROL

(75) Inventor: Hoeseong Ha, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 231 days.

(21) Appl. No.: 10/633,618

(22) Filed: Aug. 5, 2003

(65) Prior Publication Data

US 2004/0066377 A1 Apr. 8, 2004

(30) Foreign Application Priority Data

Oct. 4, 2002 (KR) ..... 10-2002-0060506

(51) Int. Cl.
*G09G 5/00* (2006.01)

(52) U.S. Cl. ..... 345/169; 348/734

(58) Field of Classification Search ..... 345/169, 345/170, 172, 168, 158, 664; 348/158, 734; 455/418–419; 340/531, 825.69; 375/240.12; 725/25; 341/176, 22

See application file for complete search history.

(56) References Cited

U.S. PATENT DOCUMENTS

| | | | | |
|---|---|---|---|---|
| 5,923,268 | A | 7/1999 | Takahashi et al. | |
| 6,211,870 | B1 * | 4/2001 | Foster | 715/744 |
| 6,262,780 | B1 | 7/2001 | Ho et al. | |
| 6,587,067 | B2 * | 7/2003 | Darbee et al. | 341/176 |
| 6,795,130 | B2 * | 9/2004 | Shibamiya | 348/734 |
| 2002/0024617 | A1 | 2/2002 | Kwon | |

FOREIGN PATENT DOCUMENTS

| | | | |
|---|---|---|---|
| JP | 08-237777 | * | 9/1996 |
| JP | 10-208329 | A | 8/1998 |
| JP | 11-18177 | A | 1/1999 |
| KR | 1994-25376 | | 11/1994 |
| KR | 1996-15364 | | 11/1994 |
| KR | 1996-0002835 | B1 | 2/1996 |
| KR | 1997-0032232 | A | 6/1997 |
| KR | 0135855 | B1 | 1/1998 |
| KR | 1999-0048990 | A | 7/1999 |
| KR | 20-0168681 | Y1 | 2/2000 |

* cited by examiner

*Primary Examiner*—Richard Hjerpe
*Assistant Examiner*—Abbas I. Abdulselam
(74) *Attorney, Agent, or Firm*—Sughrue Mion, Pllc.

(57) ABSTRACT

A method of controlling a universal remote control, and more particularly, a method of controlling a universal remote control by which the universal remote control can be used to select external inputs into a display apparatus such as a TV without changing equipment modes of the universal remote control several times. The method of controlling the universal remote control for remotely controlling a plurality of equipment including the display apparatus, having the steps of, if an external input select button of the universal remote control is selected, determining whether input buttons of the universal remote control related to selection of external inputs into the display apparatus are selected; changing an equipment mode of the universal remote control to a display apparatus mode; and transmitting key codes corresponding to the selected input buttons.

17 Claims, 6 Drawing Sheets

METHOD OF CONTROLLING UNIVERSAL REMOTE CONTROL

BACKGROUND OF THE INVENTION

1. Field of Invention

The present invention relates to a method of controlling a universal remote control, and more particularly, to a method of controlling a universal remote control by which the universal remote control can be used to select external inputs into a display apparatus, such as a TV, without changing equipment modes of the universal remote control several times.

The present application is based on Korean Patent Application No. 10 2002-0060506, filed Oct. 4, 2002, which is incorporated herein by reference in its entirety.]

2. Description of the Prior Art

As remote controls are widely used for the control of electronic equipment, the number of remote controls used in a home has increased. Therefore, there is difficulty in managing the remote controls. There is also inconvenience in that whenever a user wants to newly select and utilize other electronic equipment, the user should accordingly exchange one remote control with one another. To solve these problems, there has recently been proposed a universal remote control that allows one remote control itself to control a variety of equipment.

FIG. 3 is a block diagram showing a system configuration of a general TV or other electronic appliance controlled by the universal remote control. A system of general electric home appliances controlled by the universal remote control will be described with reference to FIG. 3. The system includes a TV 10 and external equipment 20. The external equipment 20 may include a VCR, a DVD player and a DTV set-top box, for reproducing or receiving a plurality of media. For example, a video tape, a DVD, DTV, general ground wave broadcasts and the like, so that a user can reproduce or view relevant media. The TV 10 is used as an apparatus for outputting video signals from the external equipment 20. That is, all the video outputs from the VCR, the DVD player, the set-top box and the like are input into an external signal input unit 11 of the TV 10 and then transmitted together with ground wave TV signals selected by a ground wave tuner 12 to a video signal selection unit 13. At this time, the user operates a TV/external input select button 311 of the universal remote control shown in FIG. 4*b* so that a desired video signal can be displayed on a display unit 15. A control signal corresponding to the TV/external input selection of the universal remote control is transmitted through a remote-control signal receiving unit 14 to the video signal selection unit 13.

As for the selection of the video signal selection unit 13, the conventional TV 10 employs a toggle method in which video signals to be output whenever the user selects the TV/external input select button 311 are circulated and thus changed. However, there has recently been a tendency to change toward a menu list method in which when the user selects the TV/external input select button 311, a menu list for the selection of the external inputs is displayed on the display unit 15 of the TV as shown in FIG. 5 and the user selects an external input of the menu list by using direction buttons 312, a select button 313 and a cancel button 315.

The conventional universal remote control shown in FIG. 4*a* includes a key input unit 31 with a key matrix composed of a plurality of input buttons for controlling the external equipment 20 in addition to several input buttons shown in FIG. 4*b*. These input buttons include common buttons used for a variety of equipment among the external equipment 20, for example, the direction buttons 312, the select button 313, the cancel button 315 and the other buttons 316; individual buttons such as a play button and a stop button (not shown) for each piece of the external equipment 20; and an equipment setting button 314 for setting the external equipment to be controlled by the universal remote control. In operation, the direction buttons 312, the select button 313 and the cancel button 315 are selected for movement toward, selection and cancellation of a desired menu when a menu list of the TV 10 or a relevant one of the external equipment 20 is displayed on the display unit 15 of the TV 10.

The conventional universal remote control stores key codes for various equipment in a memory 33 in order to control the different types of external equipment 20. According to a selected value of the equipment setting button 314 and a selected value of an input button selected from the key input unit 31, a remote-control control unit 32 transmits a key code for the selected input button to a remote-control signal transmitting unit 34. The selected value of the equipment setting button 314, i.e. an equipment mode of the remote control, is stored in the memory 33. Upon selection of the equipment setting button 314, the equipment mode of the remote control is changed into DTV, TV, VCR, CATV or DVD as shown in FIG. 4*b*, and then stored. For example, if the selected value of the equipment setting button 314 is DVD, the remote-control control unit 32 generates key codes for controlling the DVD player according to selected values of input buttons selected from the key input unit 31. Further, the conventional universal remote control provides the additional individual button 311 for the selection of the external input into the TV 10, which is frequently utilized. If the TV/external input select button (hereinafter, referred to as "external input select button") 311 is selected, the remote-control control unit 32 recognizes the selection as a kind of interrupt command and generates a key code for the TV 10 regardless of the selected value of the equipment setting button 314, i.e. the equipment mode of the remote control. However, key codes for the buttons, except the external input select button 311, are generated by referencing the equipment mode of the remote control. Therefore, when cursor movement is made or a certain external input is selected in the menu list displayed on the display unit 15 of the TV 10 shown in FIG. 5 by using the conventional universal remote control, a lot of cumbersome selection operations of the equipment setting button 314 occur.

A case will be discussed below, where the displayed video is changed to output video from the VCR, while output video from a DVD is displayed on the display unit of the TV 10. After reproduction of the DVD is first stopped, the menu list for selection of the external inputs is displayed on the display unit 15 of the TV 10 by selecting the external input select button 311. Then, the equipment mode of the universal remote control is changed to TV mode by using the equipment setting button 314 of the remote control. Subsequently, cursor movement is made in the menu list by using the direction buttons 312 to select the VCR as the external input, and the select button 313 is pressed. Now, the external input of the TV 10 is set as the VCR, and the equipment mode of the remote control is changed to VCR mode by again using the equipment setting button 314 of the remote control. When a VCR play button (not shown) is pressed, the VCR is started and the output video from the VCR is displayed on the display unit of the TV 10.

As a result, in the case where the output video from the DVD displayed on the display unit of the TV 10 is intended to be changed to the output video from the VCR, the equipment setting button 314 should be selected at least twice. This is because the cursor movement and selection in the menu list can be made only in TV mode even though the menu list for selection of the external inputs into the TV 10 can be displayed in any mode of the universal remote control.

As a method of reducing the number of changes of equipment modes which are frequently made upon control of a complex system by using such a universal remote control, Korean Patent Application No. 1993-6709 discloses a method of controlling a universal remote control using an artificial intelligence key, wherein a menu of objects to be controlled is displayed on a screen of a TV when a user presses a menu key, a submenu is displayed when the user selects an object to be controlled from the displayed menu, and the selected object to be controlled can be controlled when the user selects a desired control command from the displayed submenu.

However, in the method of controlling the universal remote control in which desired external equipment can be controlled by selecting a submenu displayed on the screen of the TV, the external equipment should be connected to the TV through a network for control signals so that the control signals generated from the TV can be transmitted to the external equipment. Further, the method requires: a network system, through which, when the user selects the submenu after display of the menu of objects to be controlled on the TV, the relevant external equipment recognizes the selection and transmits its own menu to the TV; or a two-way universal remote control capable of transmitting and receiving information and control signals to and from the external equipment, rather than a conventional one-way universal remote control for only transmitting the control signals to the TV or external equipment without exchanging information with the TV or external equipment.

Therefore, if the one-way remote control is used in the general system which is composed of the TV and other electronic equipment and merely utilizes the TV only as an output apparatus for video signals as shown in FIG. 3, there is still inconvenience in that the user should operate the equipment setting button of the remote control whenever he/she changes the external inputs into the TV.

SUMMARY OF THE INVENTION

The present invention is conceived to solve the aforementioned problems. An object of the present invention is to provide a method of controlling a universal remote control by which the universal remote control can be used to select external inputs into a display apparatus such as a TV without changing equipment modes of the universal remote control many times.

According to one aspect of the present invention, there is provide a method of controlling a universal remote control for remotely controlling a plurality of equipment including a display apparatus, comprising the steps of, storing information on input buttons to be subsequently selected when an external input select button of the universal remote control is selected; determining whether the stored information on the input buttons is information on input buttons related to selection of external inputs into the display apparatus; changing an equipment mode of the universal remote control to a display apparatus mode when the stored information on the input buttons is the information on the input buttons related to the selection of the external inputs into the display apparatus; and transmitting key codes according to the stored information on the input buttons and the changed equipment mode of the universal remote control.

Preferably, the method further comprises the steps of storing the unchanged equipment mode of the universal remote control, which is the equipment mode before its change, when the stored information on the input buttons is the information on the input buttons related to the selection of the external inputs into the display apparatus; and restoring the equipment mode of the universal remote control to the stored unchanged equipment mode of the universal remote control, after the step of transmitting the key codes according to the stored information on the input buttons and the changed equipment mode of the universal remote control.

Further, it is preferred that the input buttons related to the selection of the external inputs include at least one of a select button and a cancel button.

Preferably, the input buttons related to the selection of the external inputs include direction buttons.

More preferably, the method further comprises the step of transmitting key codes according to a current equipment mode of the universal remote control and the stored information on the input buttons when the stored information on the input buttons is not the information on the input buttons related to the selection of the external inputs into the display apparatus.

According to another aspect of the present invention, there is provided a method of controlling a universal remote control for remotely controlling a plurality of equipment including a display apparatus, comprising the steps of, displaying a menu list for selection of external inputs into the display apparatus and storing information on input buttons to be subsequently selected when an external input select button of the universal remote control is selected; determining whether the stored information on the input buttons is information on input buttons related to the selection of the external inputs into the display apparatus; changing an equipment mode of the universal remote control to a display apparatus mode when the stored information on the input buttons is the information on the input buttons related to the selection of the external inputs into the display apparatus; and transmitting key codes according to the stored information on the input buttons and the changed equipment mode of the universal remote control, and performing cursor movement, selection or cancellation in the menu list for the selection of the external inputs into the display apparatus.

Preferably, the method further comprises the steps of storing the unchanged equipment mode of the universal remote control, which is the equipment mode before its change, when the stored information on the input buttons is the information on the input buttons related to the selection of the external inputs into the display apparatus; and restoring the equipment mode of the universal remote control to the stored unchanged equipment mode of the universal remote control, after the step of transmitting the key codes according to the stored information on the input buttons and the changed equipment mode of the universal remote control.

Further, it is preferred that the input buttons related to the selection of the external inputs include at least one of a select button, a cancel button, and direction buttons.

According to a further aspect of the present invention, there is provided a method of controlling a universal remote control for remotely controlling a plurality of equipment including a display apparatus, comprising the steps of, displaying a menu list for selection of external inputs into the display apparatus by selecting an external input select button of the universal remote control; changing an equipment mode of the universal remote control to a display apparatus mode when input buttons to be subsequently selected are input buttons related to the selection of the external inputs into the display apparatus; and performing cursor movement, selection or cancellation in the menu list for the selection of the external inputs into the display apparatus according to information on the selected input buttons and the changed equipment mode of the universal remote control.

Preferably, the input buttons related to the selection of the external inputs include at least one of a select button, a cancel button, and direction buttons.

BRIEF DESCRIPTION OF THE DRAWINGS

The above aspects of the present invention will become apparent from the following description of an exemplary embodiment given in conjunction with the accompanying drawings, in which.

DETAILED DESCRIPTION OF THE PREFERRED EMBODIMENTS

Hereinafter, a method of controlling a universal remote control according to the present invention will be described in detail with reference to the accompanying drawings.

Figure 1:
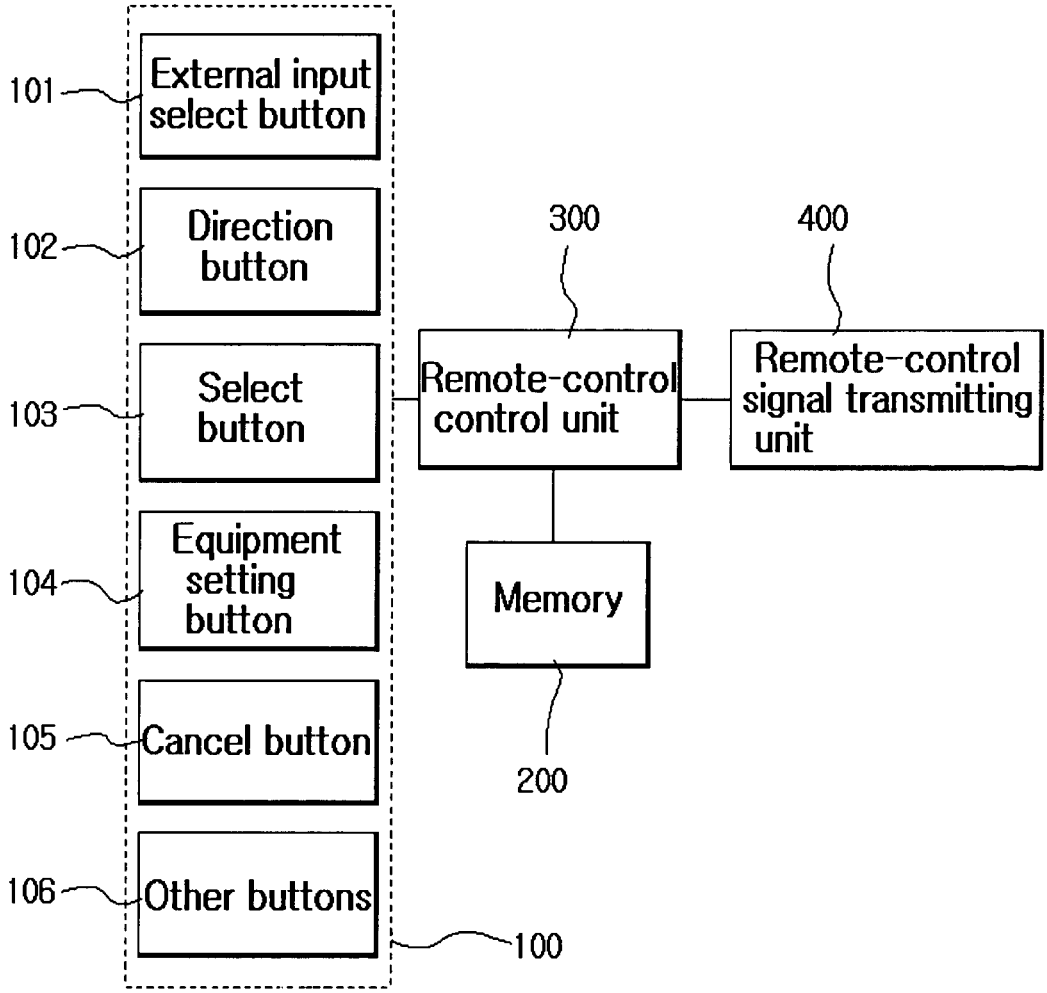
FIG. 1 is a block diagram of a universal remote control in which a method of controlling the universal remote control according to the present invention is employed.

FIG. 1 is a block diagram of a universal remote control in which a method of controlling the universal remote control according to the present invention is employed.

Figure 4A:
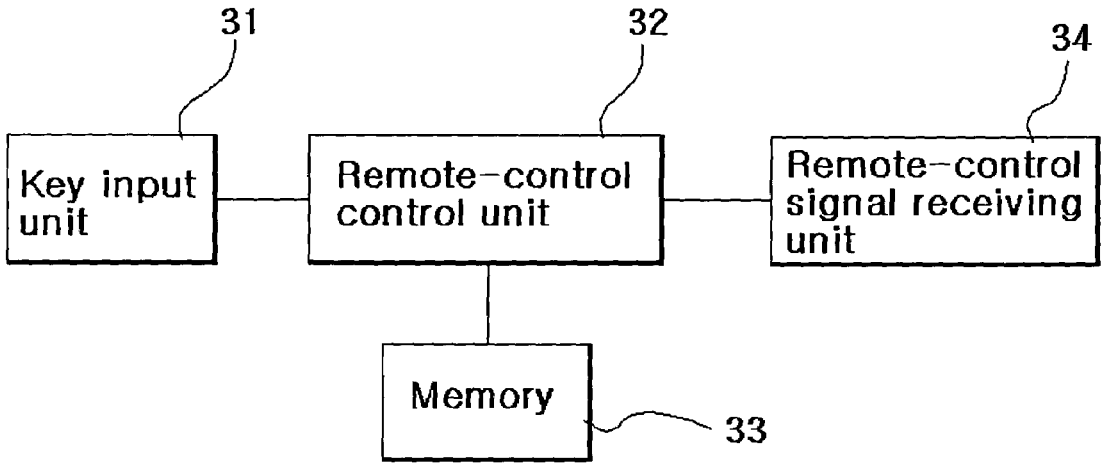
FIG. 4*a* is a block diagram of a conventional universal remote control.
Figure 4B:
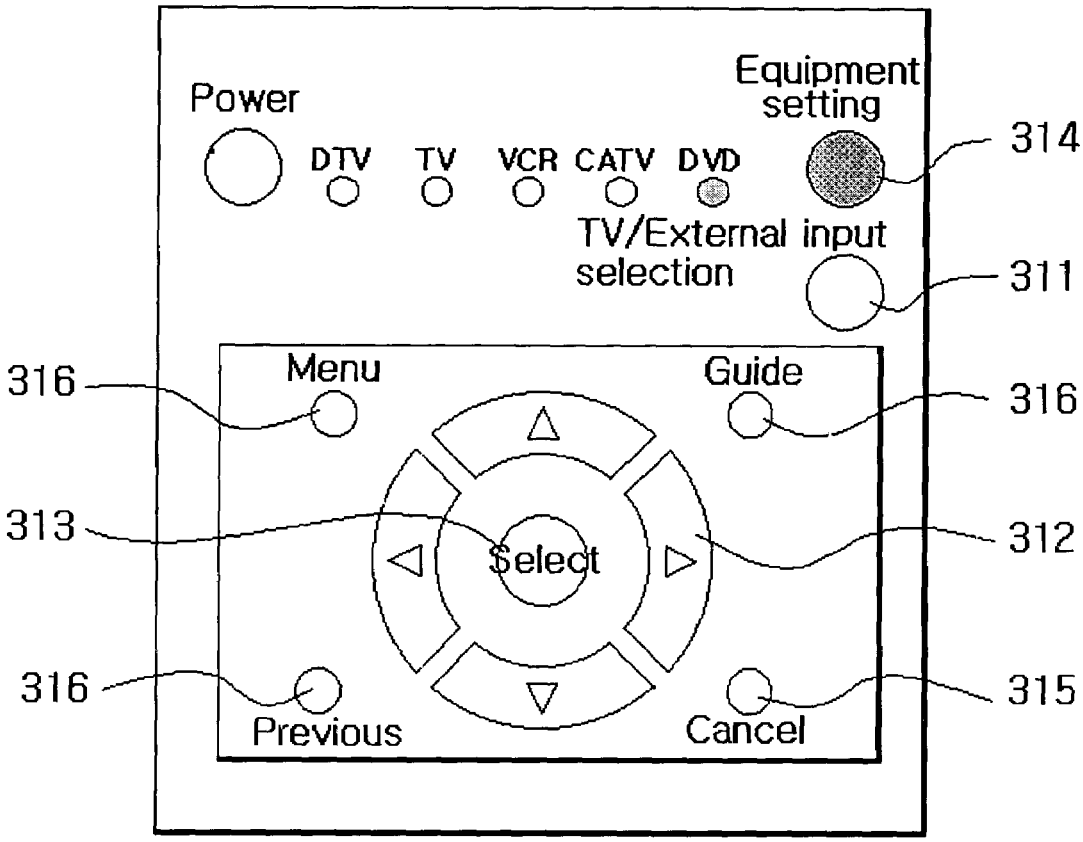
FIG. 4*b* is a view showing a layout of some buttons of the conventional universal remote control.
Figure 5:
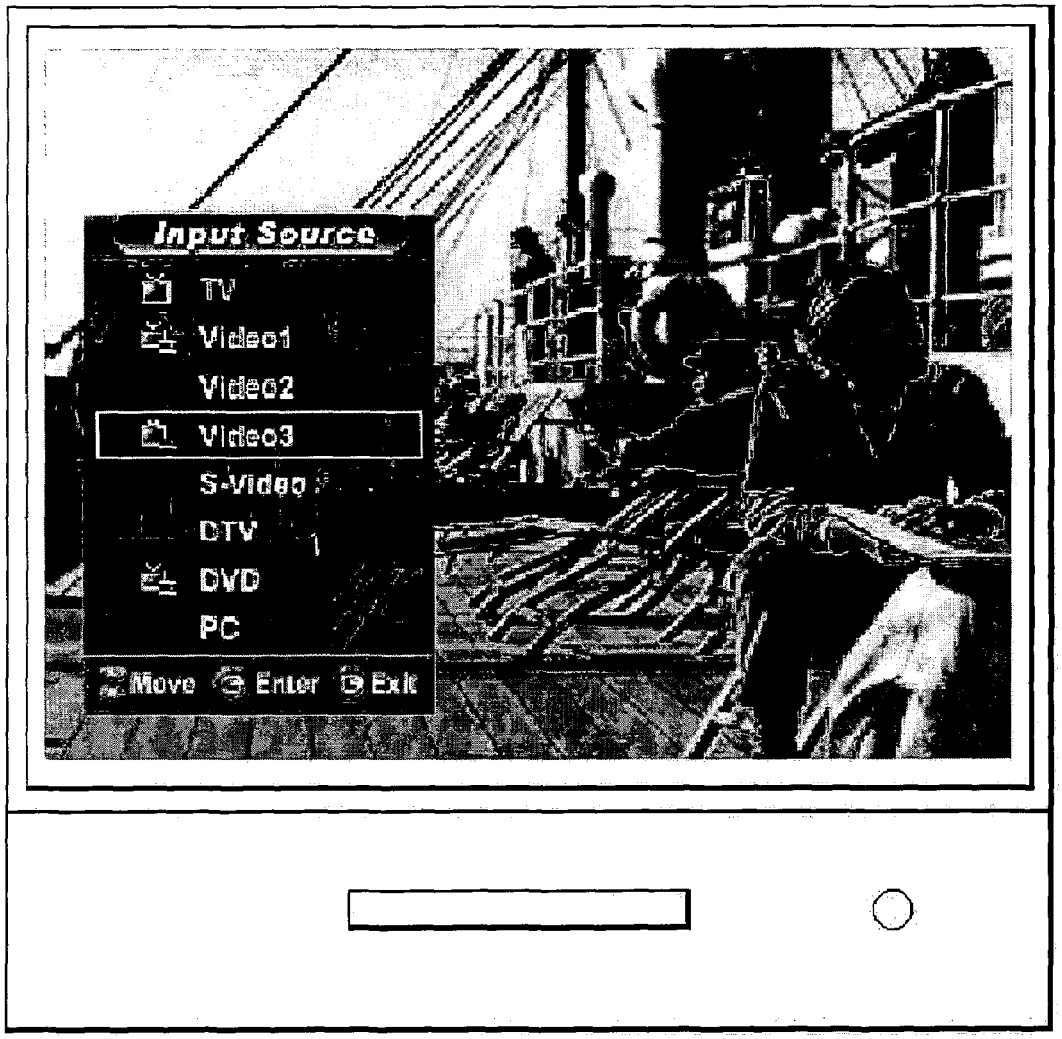
FIG. 5 is a view showing a menu list for selection of external inputs displayed on a screen of the conventional TV.

The universal remote control of the present invention comprises: a key input unit 100 on which a plurality of input buttons, such as shown in FIG. 4*b*, for controlling external equipment 20 are disposed; a memory 200 in which respective equipment key codes, an equipment mode of the remote control, and information on the input buttons including selected value of the input buttons input after the selection of an external input select button are stored; a remote-control control unit 300 for generating key codes for the input buttons selected on the key input unit 100 by referencing the equipment key codes stored in the memory 200; and a remote-control signal transmitting unit 400 for performing an optical communication function.

The key input unit 100 includes the external input select button 101, direction buttons 102, a select button 103, an equipment setting button 104, a cancel button 105, the other buttons 106, and the like. For clear understanding of the present invention, the configuration of numeric input keys and general buttons for record/play/stop/rewind functions, and the like, are not shown in the figure. Since the configuration and functions of the input buttons of the key input unit 100 are identical with those of a key input unit 31 of a conventional universal remote control shown in FIG. 4*a*, a detailed description thereof will be omitted.

The memory 200 is configured to store the equipment key codes for controlling different types of external equipment 20.

The remote-control control unit 300 causes the equipment mode to be stored in the memory 200 whenever the equipment setting button 104 of the key input unit 100 is selected. Alternatively, the control unit 300 causes the key codes for the selected input buttons to be transmitted to the remote-control signal transmitting unit 400 by referencing the equipment key codes according to the current equipment mode stored in the memory 200, when other key buttons of the key input unit 100 are selected. Further, information on buttons to be subsequently selected is temporarily stored in the memory 200, when the external input select button 101 is selected. At this time, if the information on the selected input buttons is information on the direction buttons 102, the select button 103 or the cancel button 105 in relation to the selection of external inputs into the TV, the current equipment mode of the universal remote control is separately stored in the memory 200. Then, the current equipment mode of the universal remote control is changed to TV mode, and a relevant key code is generated and transmitted by referencing the information on the input buttons and a TV key code stored in the memory 200. If the stored information on the input buttons is information on input buttons other than the direction buttons 102, the select button 103 or the cancel button 105 in relation to the selection of the external inputs into the TV, the current equipment mode of the universal remote control is not changed and the relevant key code is generated and transmitted by referencing to the equipment key codes stored in the memory 200 according to the current equipment mode stored in the memory 200.

For reference, the memory 200 is composed of general storage devices such as DRAM, SRAM, EEPROM, and flash memory. The equipment mode of the remote control and the information on the input buttons may be stored in an additional memory other than the memory 200 in which the equipment key codes are stored.

Figure 2:
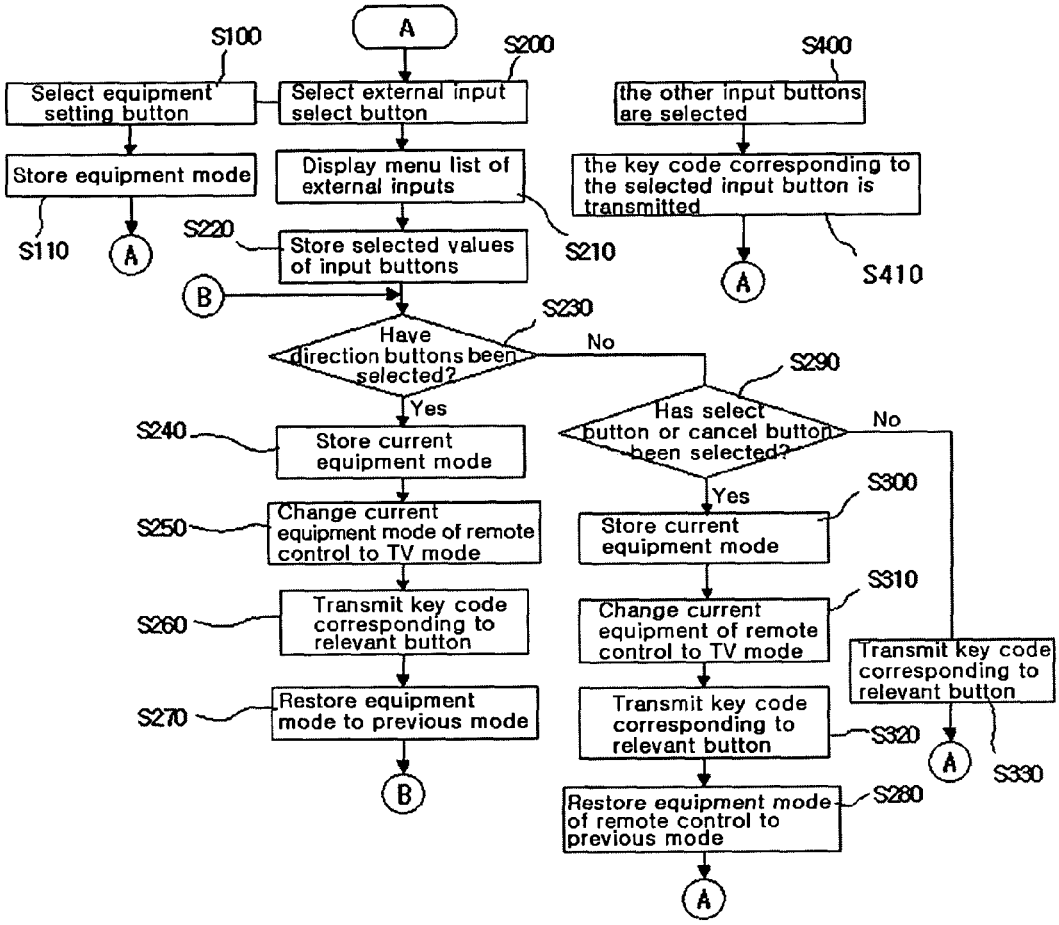
FIG. 2 is a flowchart illustrating the method of controlling the universal remote control according to the present invention.
Figure 3:
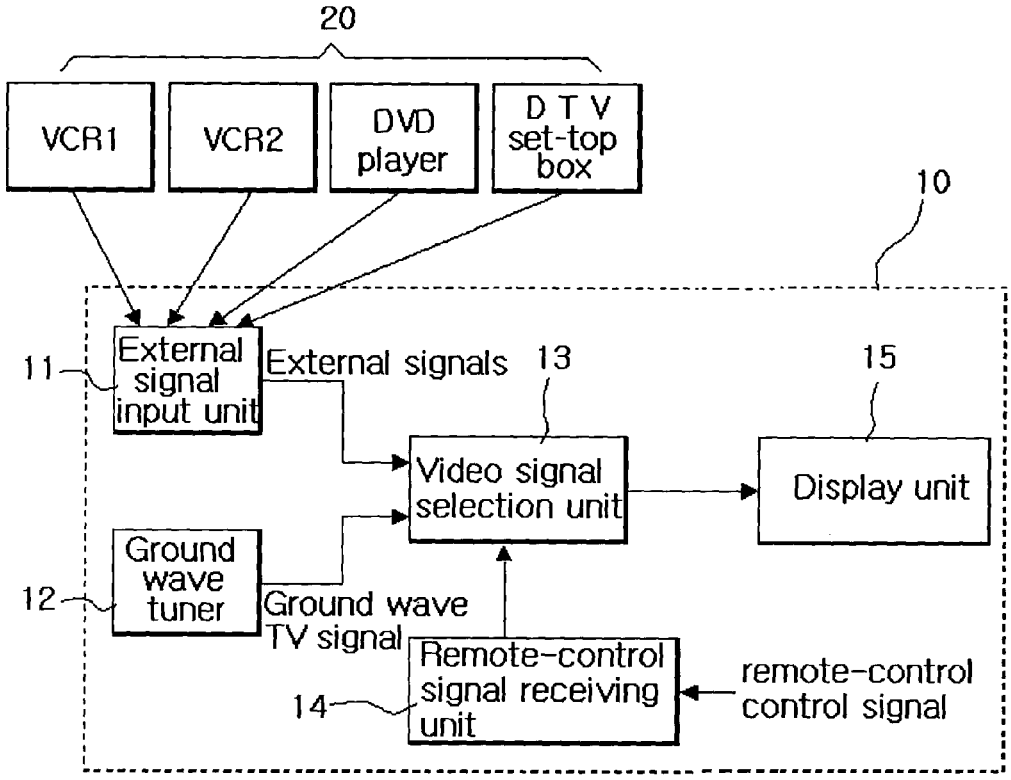
FIG. 3 is a block diagram showing a system configuration of a conventional TV and other electronic appliances.

Hereinafter, the method of controlling the universal remote control according to the present invention will be described in detail with reference to a flowchart of FIG. 2.

When the equipment setting button 104 is selected (S100), the remote-control control unit 300 causes a selected equipment mode to be stored in the memory 200 (S110). Alternatively, when the other input buttons are selected (S400), the key code corresponding to the selected input button is generated and transmitted by referencing the equipment key code according to the equipment mode stored in the memory 200 (S410).

If the external input select button 101 is selected (S200), the remote-control control unit 300 recognizes the selection as a kind of interrupt command. This causes the key code for the TV 10 to be generated regardless of the equipment mode stored in the memory 200 and then a menu list of external inputs to be displayed on the display unit 15 of the TV 10 (S210).

Then, the selected values of the input buttons input after the selection of the external input select button 101, i.e. the information on the input buttons, are stored in the memory 200 (S220), and it is determined whether the stored information on the input buttons is information on the direction buttons 102 (S230). If it is determined that the direction buttons 102 has been selected, since the selected direction buttons are buttons related to the selection of the external inputs into the TV, the remote-control control unit 300 causes the current equipment mode of the universal remote control to be separately stored in the memory 200 (S240) and then changed to TV mode (S250), and the key code corresponding to the stored information on the direction buttons to be generated and transmitted by referencing the TV code stored in the memory 200 (S260). Further, cursor movement is made in the menu list of the external inputs displayed on the display unit 15 of the TV 10 in response to the transmitted key code.

Thereafter, the control unit 300 causes the current equipment mode to be restored to the separately stored equipment mode before its change (S270), and waits for the next button input in a state where the menu list of the external inputs is displayed.

At step S230, where it is determined whether the direction buttons have been selected, if the stored information on the input buttons is not the information on the direction buttons 102, it is again determined whether the stored information is the information on the select button 103 or the cancel button 105 (S290). If it is determined that the select button 103 or the cancel button 105 has been selected, the remote-control control unit 300 causes the current equipment mode to be separately stored in the memory 200 (S300) and changed to TV mode (S310), and causes the key code corresponding to the stored information on the select or cancel button to be generated and transmitted by referencing the TV key code stored in the memory 200 so that the menu list of the external inputs displayed on the display unit 15 of the TV 10 can be selected or cancelled.

Then, the equipment mode of the universal remote control is restored to the separately stored equipment mode before its change (S280)

At step S290, where it is determined whether the stored information on the input buttons is the information on the select button 103 or the cancel button 105, if it is determined whether other input buttons have been selected, it can be considered that a user has no intention of selecting the external inputs. Thus, the control unit causes the key code corresponding to the stored information on the relevant input button to be generated and transmitted according to the current equipment mode of the universal remote control without changing the equipment mode of the universal remote control (S330).

Next, in a case where output video from a DVD displayed on the TV 10 is intended to be changed to output video from a VCR as described in connection with the prior art, it will be discussed how to implement the method of controlling the universal remote control according to the present invention.

After reproduction of the DVD is first stopped, the menu list for selection of the external inputs is displayed on the screen of the TV 10 by selecting the external input select button 311 of the universal remote control. Then, without changing the equipment mode of the universal remote control, a cursor movement is made in the menu list by using the direction buttons 312 of the universal remote control to select the VCR as one of the external inputs, and the select button 313 is then pressed. Thus, the external input into the TV 10 is set as the VCR, and the equipment mode of the remote control is changed to VCR mode by using the equipment setting button 314 of the remote control. Subsequently, a VCR play button is pressed and the VCR is then reproduced. According to the method of controlling the universal remote control according to the preferred embodiment of the present invention, change of the external inputs into the TV and reproduction of VCR can be made even by changing the equipment mode of the universal remote control only once. Thus, it can be understood that the operation of the universal remote control can be made more simply as compared with the operation method in the prior art.

Although it has been described by way of example that a TV is used as the display apparatus, the present invention is not limited thereto. The present invention can be applied to various kinds of display apparatuses such as a monitor or a beam projector capable of connecting with external equipment and displaying images thereon.

According to the present invention constructed as such, even though a one-way remote control is used without using an expensive system composed of the display apparatus and external equipment which are mutually controllably connected with each other, or using a universal remote control with which two-way recognition with the equipment can be made, the external input equipment can be conveniently selected without need to press the equipment setting button of the remote control several times in a case where the user intends to select the external inputs into the display apparatus such as the TV.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A method of controlling a universal remote control for remotely controlling a plurality of equipment including a display apparatus, comprising the steps of:

storing information on input buttons to be subsequently selected when an external input select button of the universal remote control is selected;

determining whether the stored information on the input buttons is information on input buttons related to selection of external inputs into the display apparatus;

storing a current equipment mode of the universal remote control and changing an equipment mode of the universal remote control to a display apparatus mode when the stored information on the input buttons is the information on the input buttons related to the selection of the external inputs into the display apparatus, and maintaining the current equipment mode of the universal remote control when the stored information on the input buttons is not the information on the input buttons related to the selection of the external inputs into the display apparatus;

transmitting key codes according to the stored information on the input buttons and the changed equipment mode or the current equipment mode of the universal remote control; and restoring the equipment mode of the universal remote control to the stored unchanged equipment mode of the universal remote control after the step of transmitting the key codes.

2. The method as claimed in claim 1, wherein the input buttons related to the selection of the external inputs include at least one of a select button and a cancel button.

3. The method as claimed in claim 1, wherein the input buttons related to the selection of the external inputs include direction buttons.

4. The method as claimed in claim 1, further comprising the step of:

transmitting key codes according to the current equipment mode of the universal remote control and the stored information on the input buttons when the stored information on the input buttons is not the information on the input buttons related to the selection of the external inputs into the display apparatus.

5. The method as claimed in claim 1, wherein the universal remote control comprises at least one button for selecting one mode from among modes of the plurality of the equipment including the display apparatus mode, and the external input select button for generating a key code for the display apparatus when pressed in any mode of the modes of the plurality of the equipment, and wherein the changing the equipment mode of the universal remote control to the display apparatus mode is made without pressing the at least one button to select one of the modes of the plurality of the equipment including the display apparatus mode.

6. The method as claimed in claim 1, wherein the equipment mode of the universal remote control is changed only to the display apparatus mode when the stored information on the input buttons is the information on the input buttons related to the selection of the external inputs into the display apparatus regardless of which external input of the external inputs is selected.

7. The method as claimed in claim 1, wherein the selection of the external inputs into the display apparatus is possible only in the display apparatus mode among modes of the plurality of the equipment including the display apparatus mode.

8. A method of controlling a universal remote control for remotely controlling a plurality of equipment including a display apparatus, comprising the steps of:

displaying a menu list for selection of external inputs into the display apparatus and storing information on input buttons to be subsequently selected when an external input select button of the universal remote control is selected;

determining whether the stored information on the input buttons is information on input buttons related to the selection of the external inputs into the display apparatus;

storing a current equipment mode of the universal remote control and changing an equipment mode of the universal remote control to a display apparatus mode when the stored information on the input buttons is the information on the input buttons related to the selection of the external inputs into the display apparatus, and maintaining the current equipment mode of the universal remote control when the stored information on the input buttons is not the information on the input buttons related to the selection of the external inputs into the display apparatus;

transmitting key codes according to the stored information on the input buttons and the changed equipment mode of the universal remote control when the equipment mode is changed, and performing cursor movement, selection or cancellation in the menu list for the selection of the external inputs into the display apparatus; and restoring the equipment mode of the universal remote control to the stored unchanged equipment mode of the universal remote control after the step of transmitting the key cores.

9. The method as claimed in claim 8, wherein the input buttons related to the selection of the external inputs include at least one of a select button, a cancel button, and direction buttons.

10. The method as claimed in claim 8, wherein the universal remote control comprises at least one button for selecting one mode from among modes of the plurality of the equipment including the display apparatus mode, and the external input select button for generating a key code for the display apparatus when pressed in any mode of the modes of the plurality of the equipment, and wherein the changing the equipment mode of the universal remote control to the display apparatus mode is made without pressing the at least one button to select one of the modes of the plurality of the equipment including the display apparatus mode.

11. The method as claimed in claim 8, wherein the equipment mode of the universal remote control is changed only to the display apparatus mode when the stored information on the input buttons is the information on the input buttons related to the selection of the external inputs into the display apparatus regardless of which external input of the external inputs is selected.

12. The method as claimed in claim 8, wherein the selection of the external inputs into the display apparatus is possible only in the display apparatus mode among modes of the plurality of the equipment including the display apparatus mode.

13. A method of controlling a universal remote control for remotely controlling a plurality of equipment including a display apparatus, comprising the steps of:

displaying a menu list for selection of external inputs into the display apparatus by selecting an external input select button of the universal remote control;

storing a current equipment mode of the universal remote control and changing an equipment mode of the universal remote control to a display apparatus mode when input buttons to be subsequently selected are input buttons related to the selection of the external inputs into the display apparatus, and maintaining the current equipment mode of the universal remote control when input buttons to be subsequently selected are not input buttons related to the selection of the external inputs into the display apparatus;

performing at least one of cursor movement, selection and cancellation in the menu list for the selection of the external inputs into the display apparatus according to information on the selected input buttons and the changed equipment mode of the universal remote control when the equipment mode is changed; and restoring the equipment mode of the universal remote control to the stored unchanged equipment mode of the universal remote control.

14. The method as claimed in claim 13, wherein the input buttons related to the selection of the external inputs include at least one of a select button, a cancel button, and direction buttons.

15. The method as claimed in claim 13, wherein the universal remote control comprises at least one button for selecting one mode from among modes of the plurality of the equipment including the display apparatus mode, and the external input select button for generating a key code for the display apparatus when pressed in any mode of the modes of the plurality of the equipment, and wherein the changing the equipment mode of the universal remote control to the display apparatus mode is made without pressing the at least one button to select one of the modes of the plurality of the equipment including the display apparatus mode.

16. The method as claimed in claim 13, wherein the equipment mode of the universal remote control is changed only to the display apparatus mode when the stored information on the input buttons is the information on the input buttons related to the selection of the external inputs into the display apparatus regardless of which external input of the external inputs is selected.

17. The method as claimed in claim 13, wherein the selection of the external inputs into the display apparatus is possible only in the display apparatus mode among modes of the plurality of the equipment including the display apparatus mode.

* * * * *